US006067753A

United States Patent [19]

Hebda

[11] Patent Number: 6,067,753

[45] **Date of Patent: *May 30, 2000**

[54] REMOTE CONTROL DOOR OPERATING DEVICE

[76] Inventor: Thomas J. Hebda, 539 S. Park Rd., Lombard, Ill. 60148

[ * ] Notice: This patent is subject to a terminal disclaimer.

[21] Appl. No.: 09/238,911

[22] Filed: Jan. 28, 1999

Related U.S. Application Data

[63] Continuation-in-part of application No. 08/867,284, Jun. 2, 1997, Pat. No. 5,930,954.

[51] Int. Cl.[7] ..... E05F 11/28

[52] U.S. Cl. ..... 49/345; 49/28

[58] Field of Search ..... 49/280, 339, 340, 49/341, 345, 25, 26, 28; 16/65, 70, 80

[56] References Cited

U.S. PATENT DOCUMENTS

| | | | |
|---|---|---|---|
| 618,053 | 1/1899 | Brown . | |
| 2,843,376 | 7/1958 | Osuch et al. . | |
| 2,924,449 | 2/1960 | Leimer . | |
| 3,284,950 | 11/1966 | Gute . | |
| 3,886,425 | 5/1975 | Weiss . | |
| 4,330,958 | 5/1982 | Richman . | |
| 4,348,835 | 9/1982 | Jones . | |
| 4,429,490 | 2/1984 | Zunkel . | |
| 4,658,545 | 4/1987 | Ingham . | |
| 4,669,218 | 6/1987 | Kornbrekke et al. . | |
| 4,972,629 | 11/1990 | Merendino et al. . | |
| 5,040,331 | 8/1991 | Merendino et al. . | |
| 5,634,296 | 6/1997 | Hebda | 49/345 |
| 5,930,954 | 8/1999 | Hebda | 49/345 |

*Primary Examiner*—Jerry Redman
*Attorney, Agent, or Firm*—Robert L. Marsh

[57] ABSTRACT

A door controlling device for opening and closing a door in a wall has a first arm, one end of which is mounted to the wall and the other end of which is pivotally attached to the second end of a second arm. The first end of the second arm is pivotally attached to the top of a door and is adapted for rotation about a horizontal axis at the first end thereof. An electric motor attached to the device has a shaft which drives a gear train, and an output shaft of the gear train is connected to the input end of an electrically operated clutch. The output shaft of the clutch is connected to the first end of one of the arms such that upon the simultaneous engagement of the clutch and the energizing of the motor, that arm will be rotated about the horizontal axis at the first end and will cause the door to be opened or closed. Also, a current measuring device for determining whether the motor is drawing on excessive amount of electric current, a door open sensor for generating a signal when the door is in a fully opened position, and a door closed sensor for generating a signal when the door is in a fully closed position are all connected to a computer to control the opening and closing of a door.

21 Claims, 10 Drawing Sheets

REMOTE CONTROL DOOR OPERATING DEVICE

This is a continuation-in-part of my copending prior application filed Jun. 2, 1997 and assigned Ser. No. 08/867,284, now U.S. Pat. No. 5,930,954, which was a continuation of my prior application filed May 16, 1994 and assigned Ser. No. 08/242,969, now U.S. Pat. No. 5,634,296.

The present invention relates to a motor driven mechanism for opening and closing a door, and in particular, to a mechanism which can be operated remotely from the door.

BACKGROUND OF THE INVENTION

Several devices are available which use an electric motor to control the opening and closing of a door to a room. Devices are also available for which the opening or closing cycle can be initiated from a remote location using an infrared transmitter and the like such as disclosed in U.S. Pat. No. 5,040,331. Such door controlling devices must be constructed so as not to suffer damage when the device is not activated and the door is manually opened or closed. Similarly, it must be constructed so as not to suffer damage when an object such as a chair blocks the opening or closing of the door as the device operates through an opening or closing cycle.

Currently available door controlling devices utilize a slip clutch or the like which create a drag or resistance when the door is manually opened or closed. Furthermore, such slip clutches do not terminate the door opening or closing cycle when the movement of the door is interrupted by contract with an item such as a chair or a person's hand and, as a result, such devices apply a force against the obstruction until the operating cycle is completed. It is, therefore, desirable to provide a door controlling device which can be operated remotely to open and close a door, which will not create resistance when the door is not manually opened or closed, and for which the opening or closing cycle will terminate when the door encounters an obstruction which prevents completion of the opening or closing cycle.

SUMMARY OF THE INVENTION

The present invention is embodied in a door controlling device for opening and closing a door in a wall. The device has a linkage having a first arm, one end of which is pivotally mounted to the wall and the other end of which is pivotally attached to the second end of a second arm. The first end of the second arm is pivotally attached to the top of a door and is adapted for rotation about a horizontal axis at the first end thereof. An electric motor attached to the device has a shaft which drives a gear train, and an output shaft of the gear train is connected to the input end of a solenoid operated clutch. The output shaft of the clutch is connected to the first end of the second arm such that upon the simultaneous engagement of the clutch and the energizing of the motor, the second arm will be rotated about the horizontal axis and will cause the door to which the device is attached to be opened or closed.

The invention also includes a start means for starting the cycle, such as a switch, or an infrared transmitter and receiver, a current measuring device for determining whether the motor is drawing an excessive amount of electric current, a door open sensor for generating a signal when the door is in a fully opened position, and a door closed sensor for generating a signal when the door is in a fully closed position. A control means, which is typically a computer, responds to the start means, the current measuring means, the door open sensor, and the door closed sensor to direct current to the electric motor and to the solenoid for the clutch upon receipt of a signal from the start means, and for terminating power to the motor and the clutch solenoid upon receipt of a signal from the current measuring means, the door open sensor or the door closed sensor.

GENERAL DESCRIPTION OF THE DRAWINGS

A better understanding of the present invention can be had after a reading of the following detailed description taken in conjunction with the drawings in which.

DETAILED DESCRIPTION OF THE PREFERRED EMBODIMENT

Figure 1:
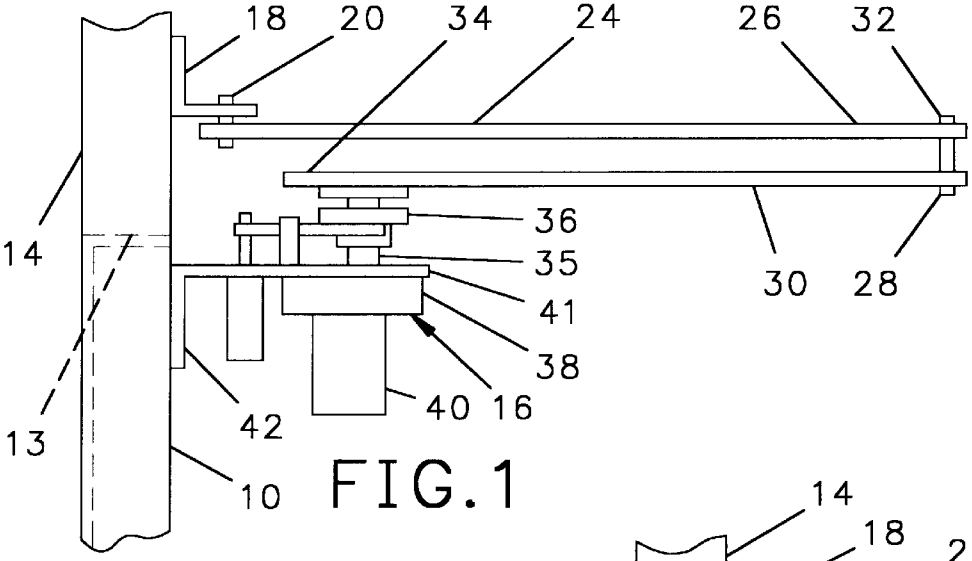
FIG. 1 is a side elevational view of a door operating device in accordance with the present invention attached to a door which is in the closed position with portions thereof shown in phantom lines.
Figure 2:
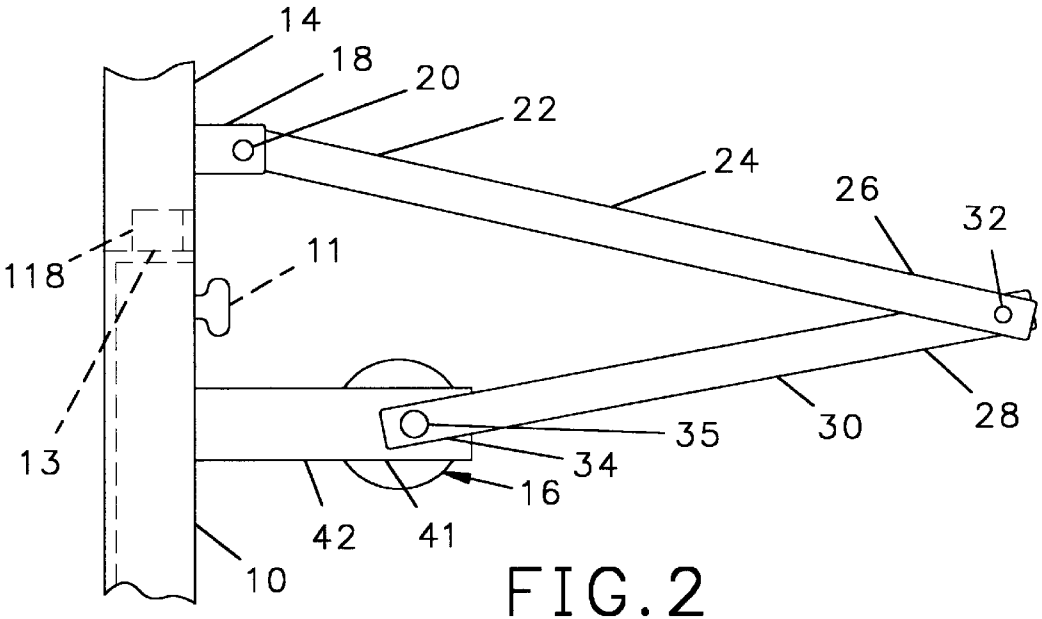
FIG. 2 is a top elevational view of the door operating device shown in FIG. 1 with the door in a closed position and the device in a first orientation as shown in solid lines and in a second orientation as shown in phantom lines.
Figure 3:
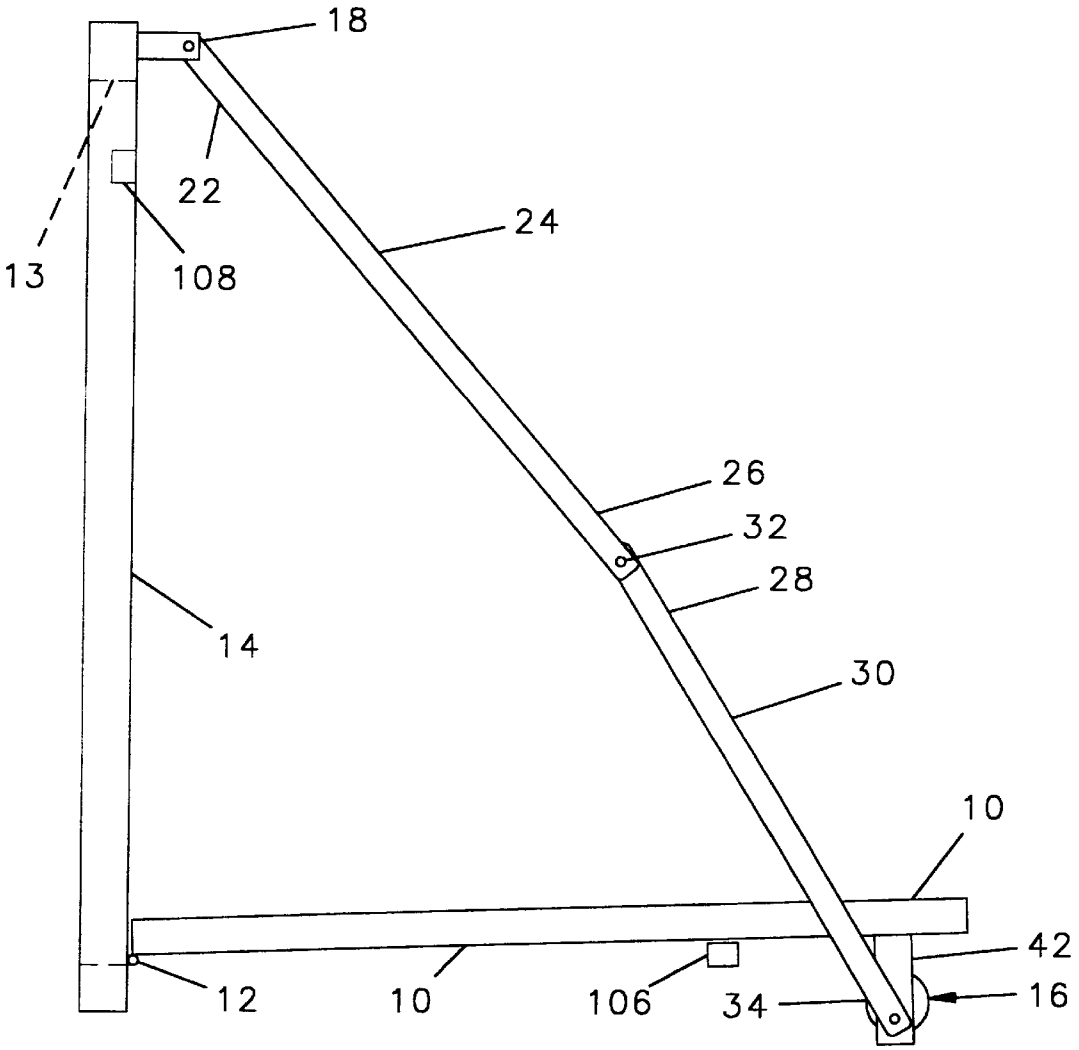
FIG. 3 is an enlarged fragmentary side elevational view of the door opening device according to the invention.

Referring to FIGS. 1, 2, and 3, a door 10 having a door knob 11 is pivotally mounted about a horizontal axis on a plurality of pins, one of which 12, is shown such that the door 10 opens and closes against a frame defining an open 13 in a wall 14. A door operating device 16 in accordance with the present invention has a first bracket 18 mounted above the door 10 and pivotally attached to the bracket 18 by a pin 20 is the first end 22 of an elongate first arm 24. The second end 26 of the first arm 24 is pivotally attached to the second end 28 of a second arm 30 by a second pin 32. The first end 34 of the second arm 30 is mounted on the distal end of the drive shaft 35, extending through a clutch 36. The drive shaft 35 extends from a gear box 38 which is connected to a motor 40, and the gear box 38 and the motor 40 assembly are rigidly mounted on a horizontal portion 41 of a second bracket 42 which is attached by screws or the like, not shown, to the top of the door 10. When the clutch 36 is engaged to the output shaft 35, the motor 40 is, therefore, drivingly connected to the first end 34 of the second arm 30.

In the preferred embodiment, the motor 40 is reversible such that rotation of the motor 40 in one direction will cause the first end 34 of the second arm 30 to rotate about the axis of the drive shaft 35 in one direction and rotation of the motor 40 in the opposite direction will cause the first end 34 to rotate about the drive shaft 35 in the opposite direction. As best seen in FIGS. 2 and 3, rotation of the second arm 30 about the shaft 35 in one direction will cause the door to move from a closed position shown in FIG. 2 to an open position shown in FIG. 3, and rotation of the arm 30 in the opposite direction about shaft 35 will cause the door to move from an open position shown in FIG. 3 to a closed position shown in FIG. 2.

Figure 4:
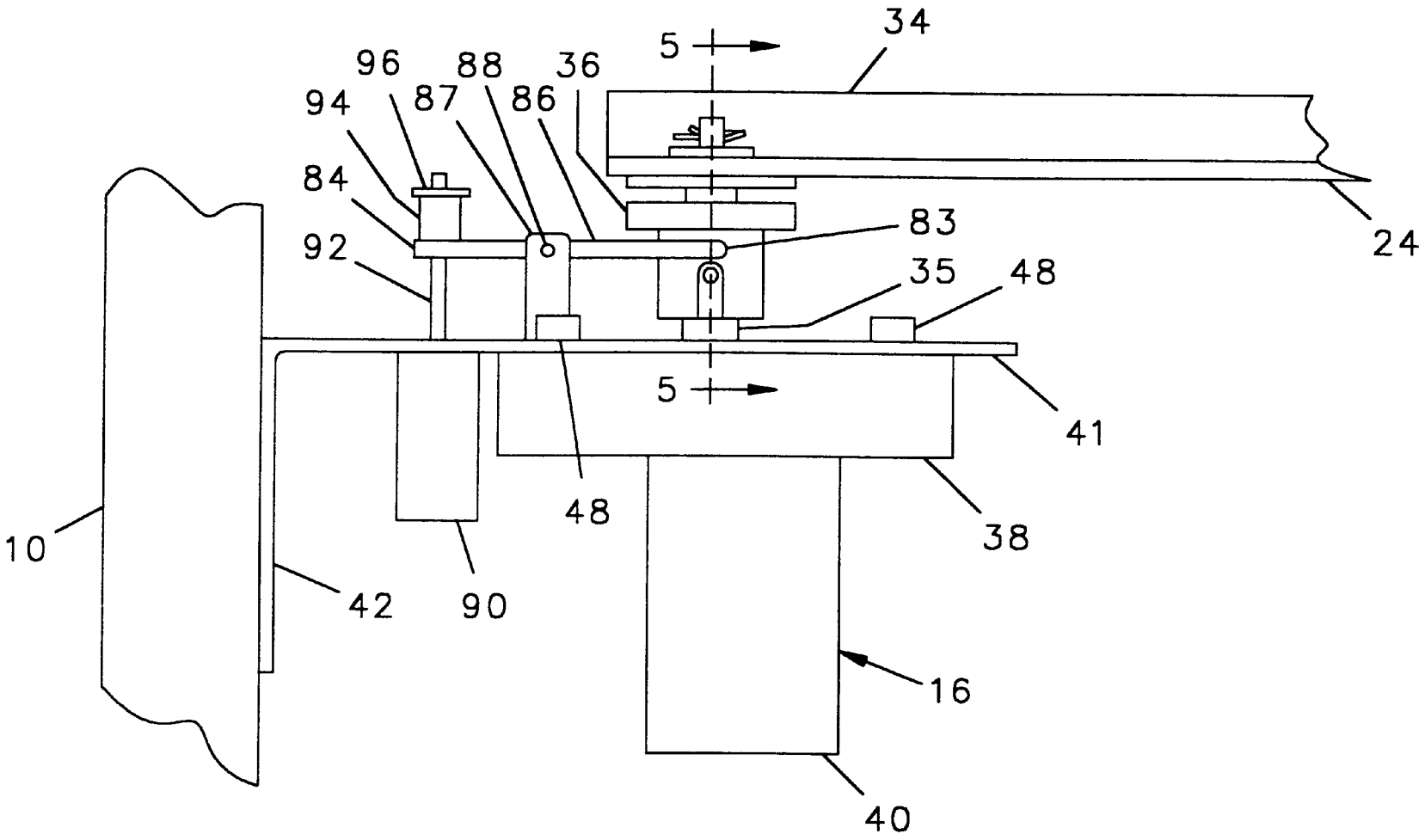
FIG. 4 is an enlarged fragmentary cross sectional view of the device shown in FIG. 3.
Figure 5:
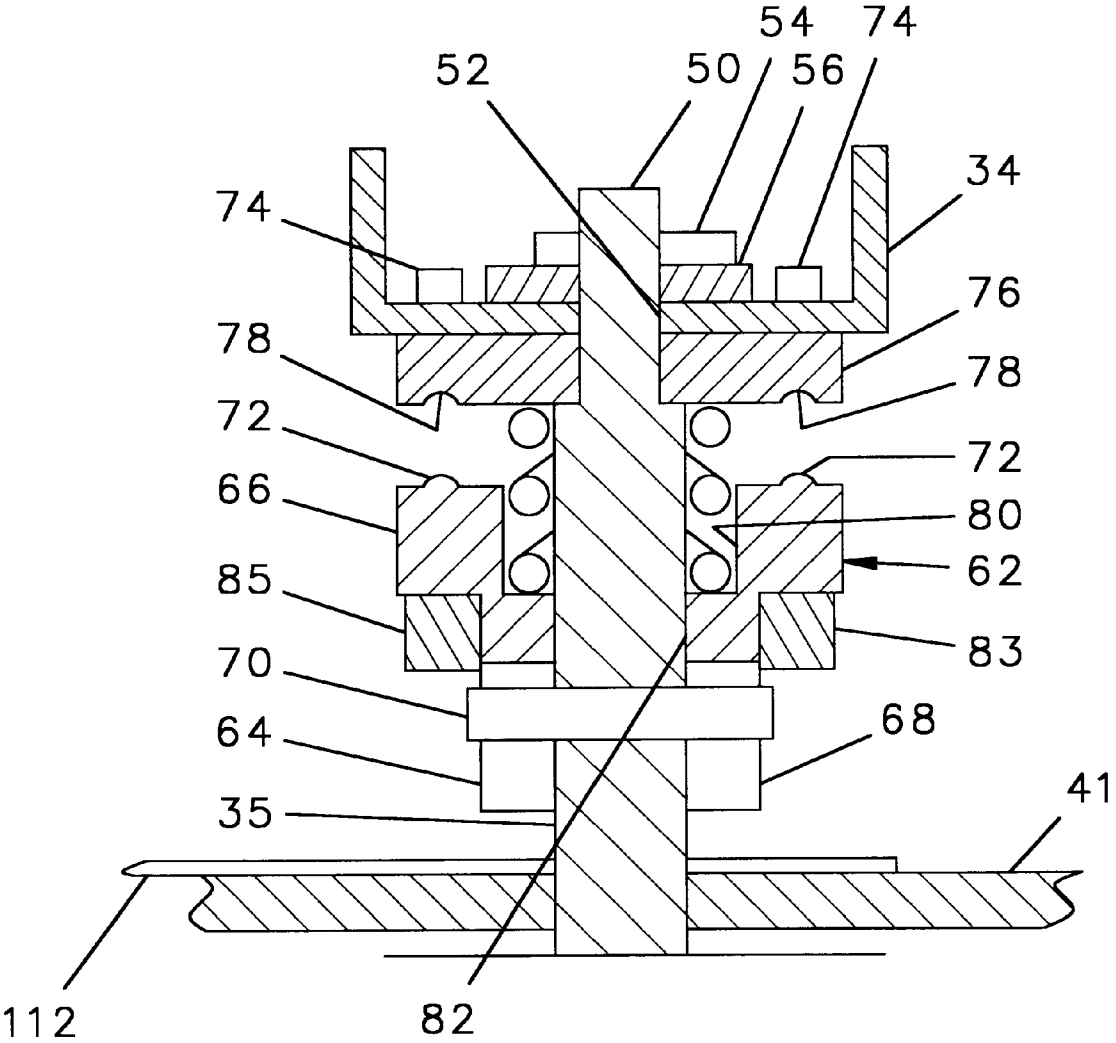
FIG. 5 is an enlarged cross sectional view of the clutch for the device as shown in FIG. 4.

Referring to FIG. 4, the gear box 38 and motor 40 are securely attached to the horizontal portion 41 of the bracket 42 by a plurality of bolts 48—48 which extend through the horizontal portion thereof and into threaded holes in the gear box 38. The drive shaft 35 from the gear box 38 extends through a hole in the horizontal portion 41, and the clutch 36 is fitted on the distal end of the drive shaft 35. As best shown in FIG. 5, the distal end 50 of the drive shaft 35 has a reduced diameter, and the first end 34 of the second arm 30 has an aperture 52 therein through which the distal end 50 extends. The second arm 30 is pivotally retained to the distal end 50 of the shaft 35 by any suitable means such as a cotter pin 54 and washer 56.

The clutch includes an axially slideable engagement member 62 having a generally tubular body 64 at the upper end of which is a radial flange 66. The tubular body 64 also has an elongate slot 68 for receiving a locking pin 70 which extends through the drive shaft 35 from the gear box 38 such that the engagement member 62 rotates with the output shaft 35 and is axially slideable along a portion of the length thereof. The upper surface of the radial flange 66 has a plurality of upwardly extending protrusions 72—72 spaced around the outer circumference thereof. Attached to the lower surface of the second arm 30 by a plurality of bolts 74—74 is an annular locking member 76 having a circular pattern of indentations 78—78, where the circular pattern of indentations 78—78 is concentric with the axis of the shaft 35 and the number of indentations and spacings thereof are identical to the number of protrusions 72—72 and spacings between protrusions on the engagement member 62. Also the shape of the indentations 78—78 is complementary to the shape of the protrusions 72—72 so that the protrusions 72—72 of the engaging member 62 will lock into the indentations 78—78 of the locking member 76 when the two are axially forced together. A counterbore 80 in the upper end of the engagement member 62 receives a compressible spring 82 which is biased to urge the engagement member 62 axially downward along the shaft 46 and away from the locking member 76.

As shown in FIGS. 4 and 5, a yoke 84 has opposing fingers 83, 85, which extend around the sides of the tubular body 64 of the engagement member 62 and an elongate arm 86. A bracket 87 mounted on the horizontal portion 41 of the second bracket 42 has a pin 88 therethrough which extends through the center of the arm 86 of the yoke 84 and acts as a fulcrum about which the yoke 84 is movable. A solenoid 90 is also mounted on the horizontal portion 41, and the solenoid 90 has an axially moveable shaft 92 which extends through an aperture in the distal end of the arm 86. A coil spring 94 is fitted around the distal end of the output shaft 92 extending through the aperture 93 and is retained thereon by a pin 96 extending through a transverse hold on the distal end of the shaft 92.

When the solenoid 90 is actuated, the shaft 92 will be drawn therein, thereby moving the distal end of the yoke arm 86 downward, as seen in FIG. 4. The downward movement of the distal end of arm 86 will force the fingers 83, 85 of the yoke 84 upward against the lower surface of the radial flange 66 and will thereby move the engagement member 62 axially upward and into engagement with the locking member 76.

The counterbore 80 and the upper surface of the engagement member 62 is sufficient to receive the coil spring 82 therein in its compressed condition such that the actuation of the solenoid 90 will cause the protrusions 72—72 on the upper surface of the engagement member 62 to engage the indentations 78—78 on the lower surface of the locking member 76, thereby causing the arm 30 to be locked to the drive shaft 35. On the other hand, when the solenoid is not energized, the coil spring 82 will urge the engagement member 62 axially downward long the shafts 35 until the protrusions 72—72 thereof no longer engage the indentations 78—78 of the locking member 76 at which time the arm 30 is freely rotatable about the axis of the drive shaft 35 such that it is not locked for rotation therewith.

As can be seen, when the solenoid 90 is not being energized, the second arm is freely rotatable about the shaft 35 and the door opening device 16 does not interfere wit the movement of the door 10. Guests entering and exiting the door 10 may, therefore, do so by grasping the door knob 11 and using it to open and close the door without interference from the device 16. When the solenoid 90 is energized, on the other hand, the clutch 36 will cause the second arm 30 to be locked to the drive shaft 35 such that rotation of the motor 42 in one direction will cause the door 10 to open with respect to the wall 14, and rotation of the motor 42 in the opposite direction will cause the door 10 to be closed with respect to the wall 14.

Figure 6:
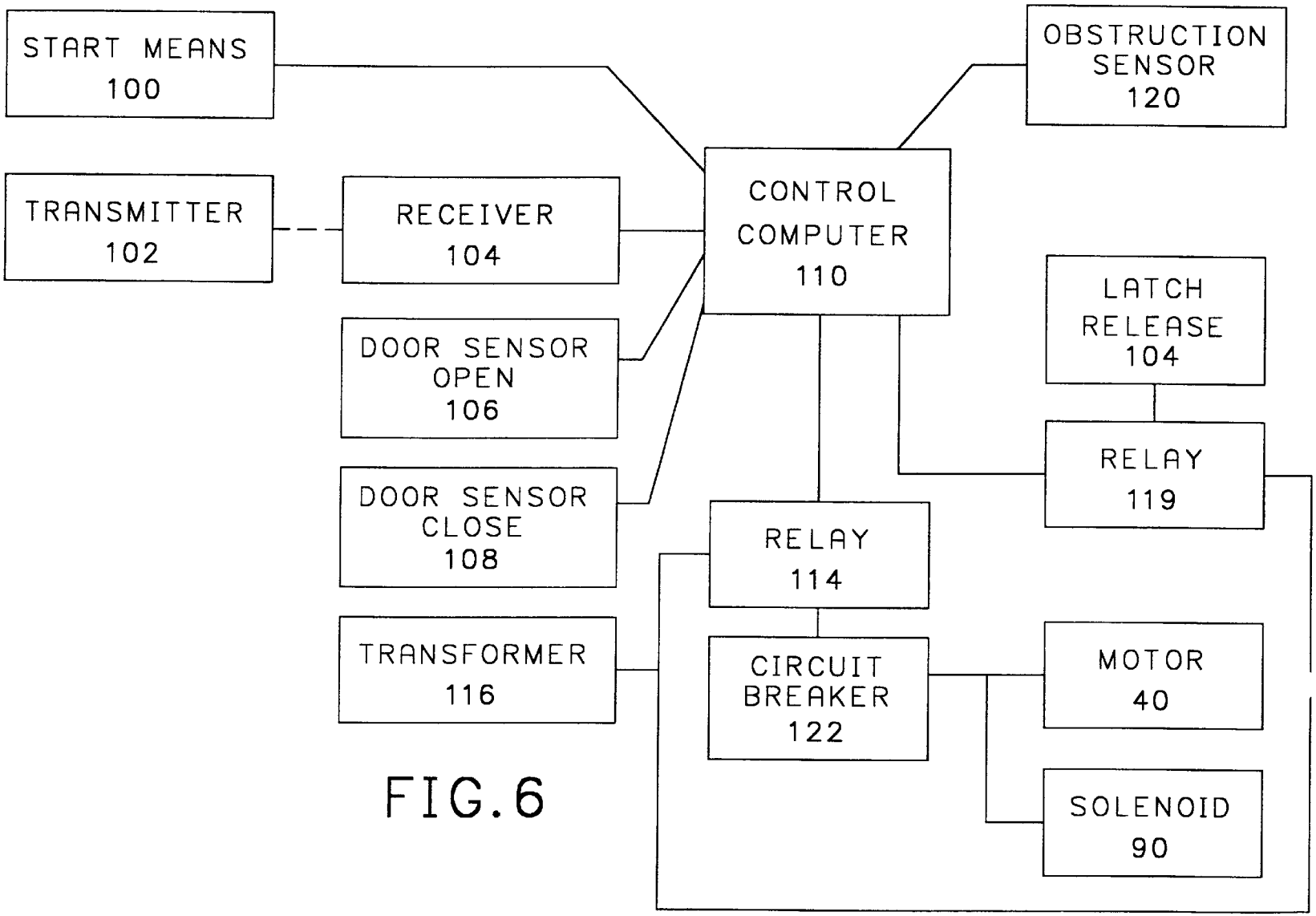
FIG. 6 is a block diagram of an embodiment of the device wherein the obstruction sensing device is a circuit breaker.

Referring to FIG. 6, to initiate a door opening or closing cycle, the invention includes a start means 100 which may be a simple button operated switch 100 located near the door 10 or on a desk within the room remote from the door. The start means can also include an infrared hand-held transmitter 102 and a receiver 104 attached to the wall 14 above the door 10 as shown in FIG. 1. The device 16 also includes a door open sensor 106 and a door close sensor 108 for determining when the door has reached the fully open or fully closed condition, respectively. The door open sensor and door closed sensor may be simple switches positioned on the floor or walls as shown in FIG. 3, so as to be actuated when the door reaches a fully open or fully closed condition or they may sense the angle of orientation of the first and second arms 24, 30, respectively, as further described below.

The circuit of the invention also includes a control means 110, which may be a computer in the form of a small chip mounted on a circuit board 112 on the horizontal portion 41 of the bracket 42 as shown in FIG. 5. The computer 110 controls a relay or transistorized switch 114 to connect or disconnect the electric motor 42 and the solenoid 90 to a source of power such as a transformer 116 attachable to an AC outlet, not shown.

As shown in FIGS. 2 and 6, the circuit might also include a latch release 118 in the frame 13 of the door and an associated relay 119 for releasing the latch of the door at the commencement of the door opening cycle. Such electrically operated latch releases are commonly known in the art and are used to unlock the outer doors of apartment buildings by pressing a button within the apartment upon recognition by an occupant using an intercom to recognize the voice of a visitor seeking admission. The latch release 118 is energized by the computer 110 at the beginning of a cycle to permit movement of the door 100 without turning the door knob 11 to open the associated latch.

The circuit also includes an obstruction sensing means 120 for sensing when an obstruction is preventing the motor 42 from opening or closing the door after a door closing or opening cycle has been commenced. In the preferred embodiment, the obstruction sensing means 120 is an ammeter and a comparator circuit of the type commonly known in the art which can be adjusted such that when the current drawn by the motor 40 exceeds the current normally required to move the door 10 through a cycle it will signal the computer 110 and the computer will disconnect the power to the motor 40. It should be appreciated that the obstruction sensing device could also be a fuse or circuit breaker 122 in the power circuit of the motor such that power will be interrupted to the motor when the motor draws an excessive amount of current as is also shown in FIG. 6.

According to the invention, the solenoid 90 is energized simultaneously with the energizing of the motor 40 and, therefore, the device 16 will not interfere with the movement of the door until the start means, such as a switch 100 or the hand-held transmitter 102 is actuated. Upon actuation of the start means 100, 102, the computer 110 will simultaneously energize the solenoid 90 and will simultaneously energize the motor 40 to rotate in the direction opposite from which it rotated during its preceding cycle. The computer 110 will continue to direct power to both the solenoid 90 and the motor 40 until a signal is received from one of the door open sensors 106, the door close sensor 108, or the obstruction sensing means 120, after which power will be terminated to both the solenoid 90 and the motor 40. If the power is terminated because of an obstruction to the door, such as a chair or person standing in the door's path, the obstruction sensing device will detect the presence of the obstruction and the computer 110 will cause the cycle to terminate. On termination of the cycle, the device 16 will be disconnected from the door and the door can again be manually moved without interference from the device 16. Once the obstruction is removed, the start means 100, 102 can be again actuated, and the computer 110 will energize the solenoid 90 and the motor 40, re-engaging the device to again open or close the door 10.

Although the clutch 36 includes a spring 82 to separate the engaging member 62 from the locking member 76, the motor 40 and gear box 38 may lock up upon termination of power to the motor 40 such that a residual force continues to be applied through the engaging member 62 to the locking member 76. The residual force between the parts 62, 76 may cause them to bind together so that they cannot be separated by the spring 82. To prevent such binding, the computer 110 can be programmed to reverse the rotation of the motor 10 for a few rotations, or a partial rotation, to alleviate such residual forces and allow the parts to separate.

Figure 7:
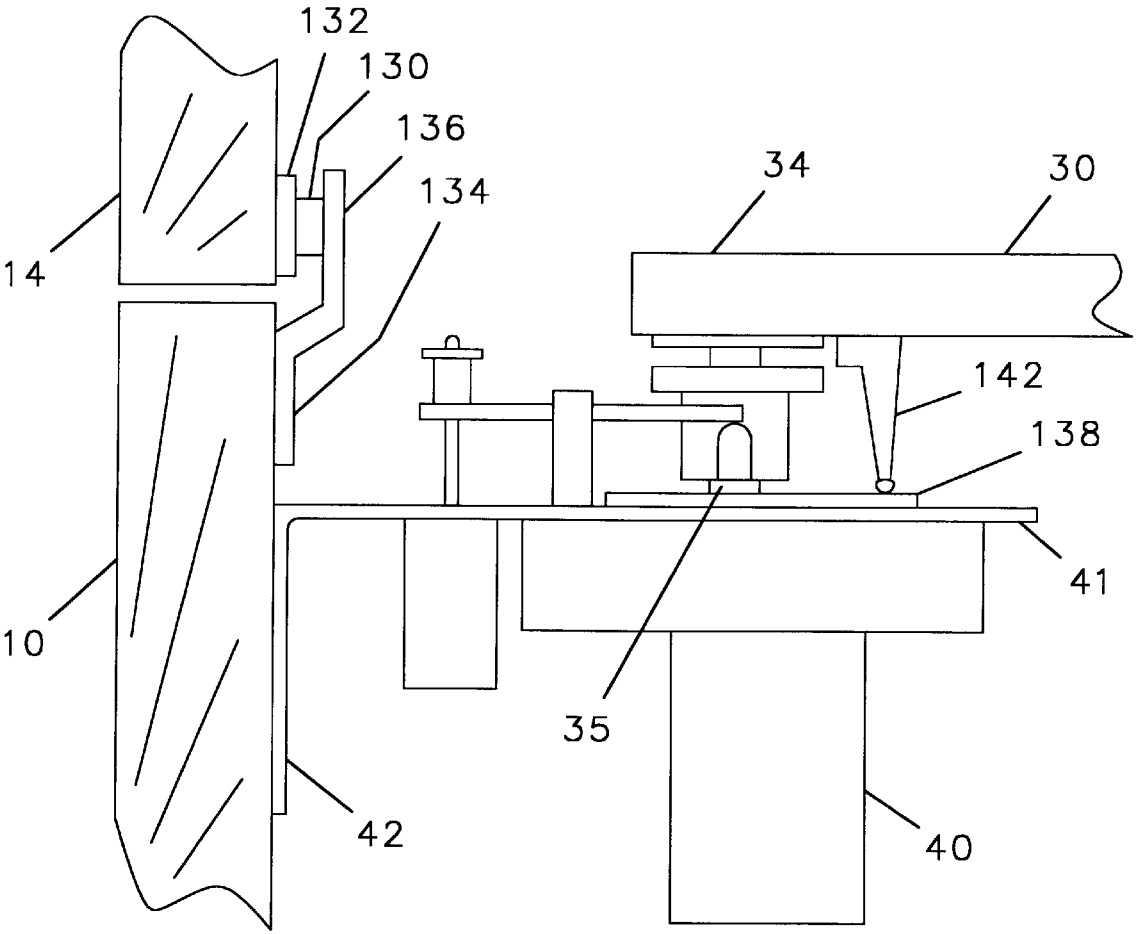
FIG. 7 is a side elevational view of a door fitted with another embodiment of the invention.

Referring to FIG. 7, an electrically operated latch release means 118 of the type known in the art are expensive, are difficult to install, and it may be desirably to omit such latch release means from a door on which the device is installed. Under such circumstances, the door should be configured such that it can be snapped open or closed without requiring that a door knob 11 be turned. In accordance with another embodiment of the present invention, the door can be retained in closed condition by providing a magnet 130 mounted on a plate 132 attached to the wall 14 above the door 10. A second plate 134 is attached to door, and the second plate has an offset contact portion 136 positioned to contact the surface of the magnet 130 when the door is closed. In this embodiment, the motor 40 must exert sufficient power to both move the door 10 through its cycle, and to overcome the magnetic force by which the magnet 130 retains the contact plate 136 thereto, thereby snapping the door free of its contact.

Figure 8:
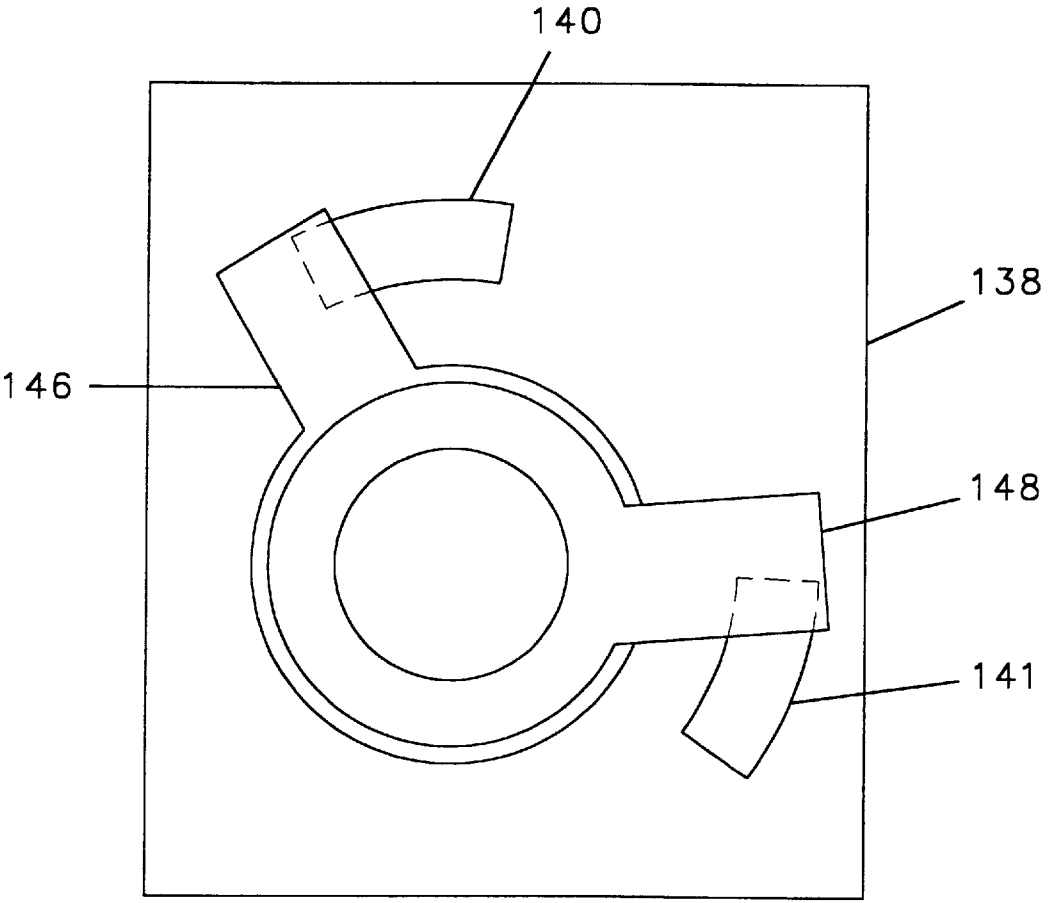
FIG. 8 is a top view of a circuit board having contacts and shields according to yet another embodiment of the invention.

Referring to FIGS. 7 and 8, the door open and door close sensors may be eliminated by providing a device for sensing the angular orientations of the second arm 30 with respect to the mounting plate 42. In accordance with this embodiment, a circuit board 138 is mounted on the horizontal portion 41 of the circuit board 138, and the circuit board 138 is oriented in a plane parallel to the plane in which the second arm rotates about the drive shaft 35. The circuit board includes two arcuate electrical contacts 140,141 where the arcs of the contacts define segments of a single circle centered at the center of the drive shaft 35. A brush 142 is mounted on the second arm 30 positioned a distance from the axis of the shaft 35 which is equal to the radius of the circle defined by the arcuate contacts 140, 141. A pair of rotatable planar non-conductive shields 146,148 are positioned on the upper surface of the circuit board 138 and locked in position to block portions of the contact surfaces 140,141 such that electrical contact can only be made between the brush 142 and one of the contacts 141, 142 on the portions thereof which are not protected by one of the shields 146, 148. The contacts 140,141 and the brush 142 are then connected to the computer 110 with one of the contacts 140 corresponding to the location of the second arm 30 with respect to the bracket 38 when the door is in the open condition and the second contact 141 corresponding to the orientation of the arm 30 with respect the bracket 38 when the door is in the closed condition. When the brush 142 makes contact with one of the contacts 140,141, current will flow through the loop formed by the brush 142 and the associated contact to provide a signal to the computer 110 that the door has reached either the closed condition or the open condition and the computer will then terminate power to the solenoid 90 and the motor 42. The contacts 140,141 and the brush 142, therefore, can be provided in substitution for mechanical switches 106,108 attached the wall 14 or floor as previously described.

Second Embodiment of the Invention

The clutch may also be constructed integral with the gearbox for reducing the output speed of the motor.

Figure 9:
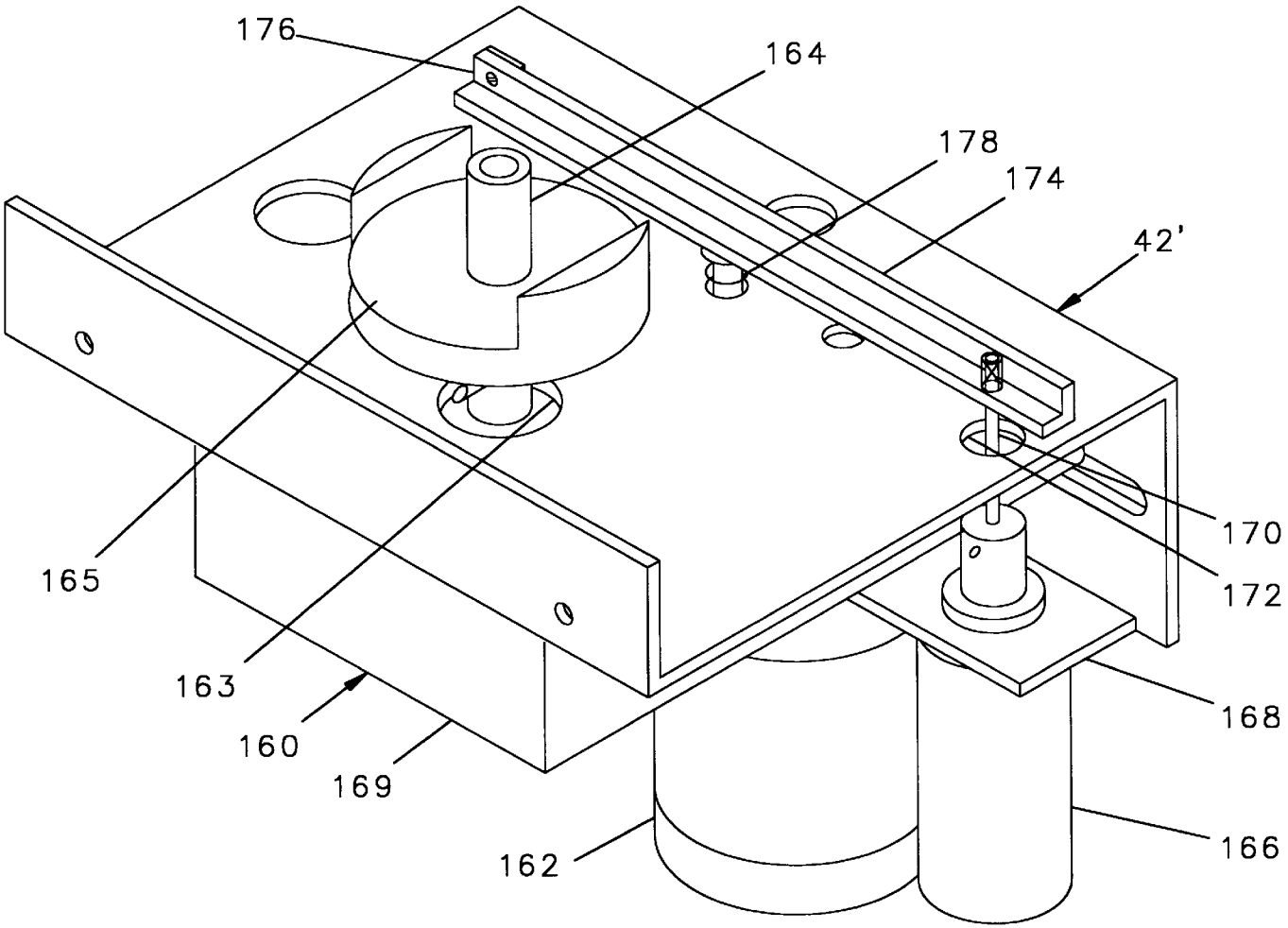
FIG. 9 is an isometric view of a modified second bracket having another embodiment of the invention.

Referring to FIG. 9, a second bracket 42' has a gearbox 160 mounted to the lower surface thereof and a motor 162 drivingly connected to the gearbox 160. The output shaft 164 of the gear box 160 extends vertically through a hole 163 in the bracket 42', and fixedly mounted to the distal end of the shaft 164 is an adapter 165 to which the second arm 30, not shown, is connected. Rotation of the output shaft 164 will rotate the second arm as described above.

A solenoid 166 is attacked by a bracket 168 to the housing 169 of the gear box 160 and an axially moveable output shaft 170 from the solenoid 166 extends vertically though a second hole 172 in bracket 42' and the distal end thereof is connected to the end of a lever arm 174. Actuation of the solenoid 166 moves the lower arm 174 about a pivot 176 on bracket 42' and movement of the lever arm 174 causes axially movement a shaft 178 attached thereto.

Figure 11:
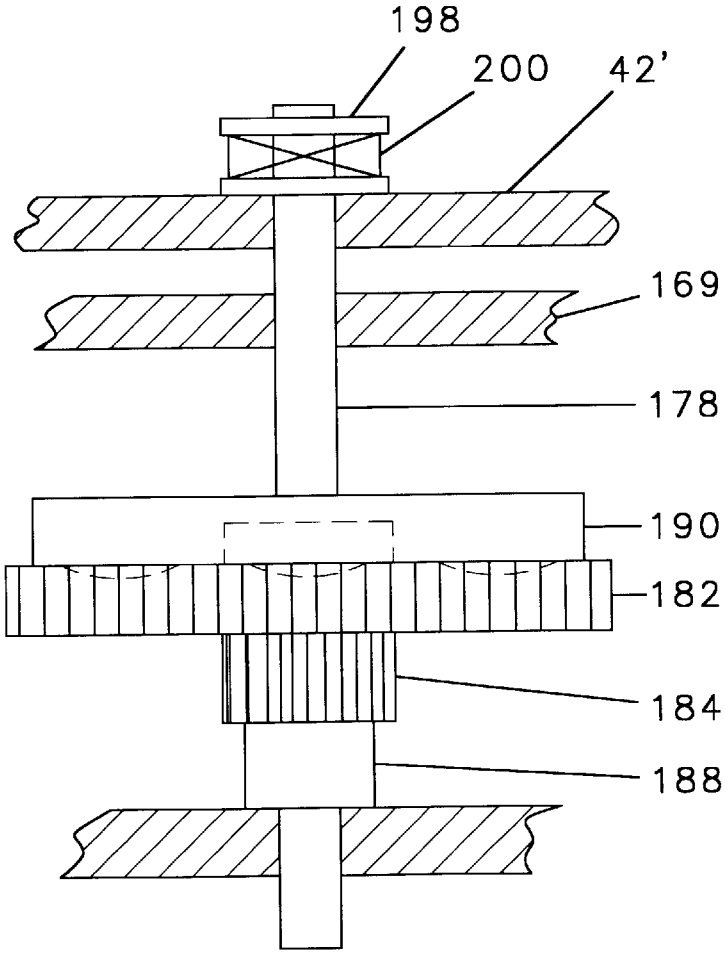
FIG. 11 is a fragmentary cross sectional view of the parts shown in FIG. 10 with the clutch engaged.
Figure 10:
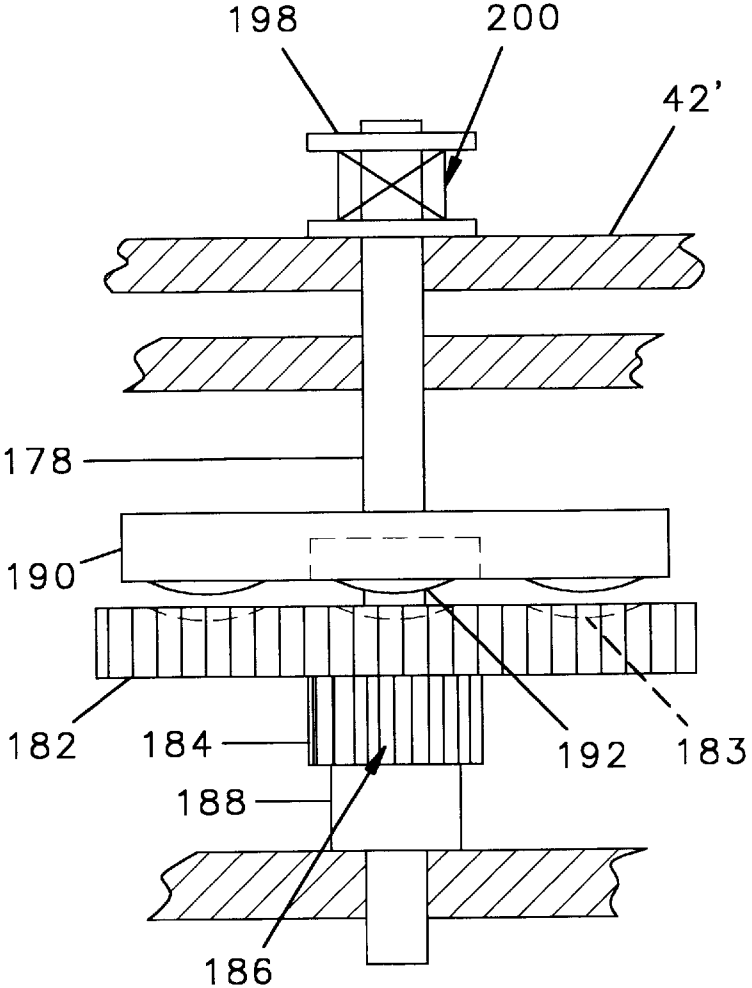
FIG. 10 is a fragmentary cross sectional view of a clutch in accordance with the embodiment shown in FIG. 9 with the parts disengaged.

For the purposes of this discussion the parts within the gear box 160 will be described in relation to their orientation as shown in FIGS. 10 and 11, such that the bracket 42' is attached to the top of the gear box 160. As shown in these figures, the shaft 178 passes through the gear box 160 with the upper end extending through a hole in the housing 169 and through another hole 180 in bracket 42' to connect with the lever arm 174. Rotatably and slideably fitted around the shaft 178 is a spurgear 182 the teeth of which engage the teeth of a gear on the motor shaft, not shown. Arranged in a circular pattern around the upper surface of the spur gear 182 are a plurality of equally spaced indentations 183—183 therein.

Abutting the lower surface of the spurgear 182 is a pinion gear 184 the teeth of which engage the teeth of another spurgear, not shown, on the output shaft 164. The pinion gear 184 is axially slideable along the shaft 178 but is locked for rotation with the shaft 178 by a key 186, and a nylon spacer 188 spaces the pinion gear 184 from the inner wall of the housing 169.

Figure 12:
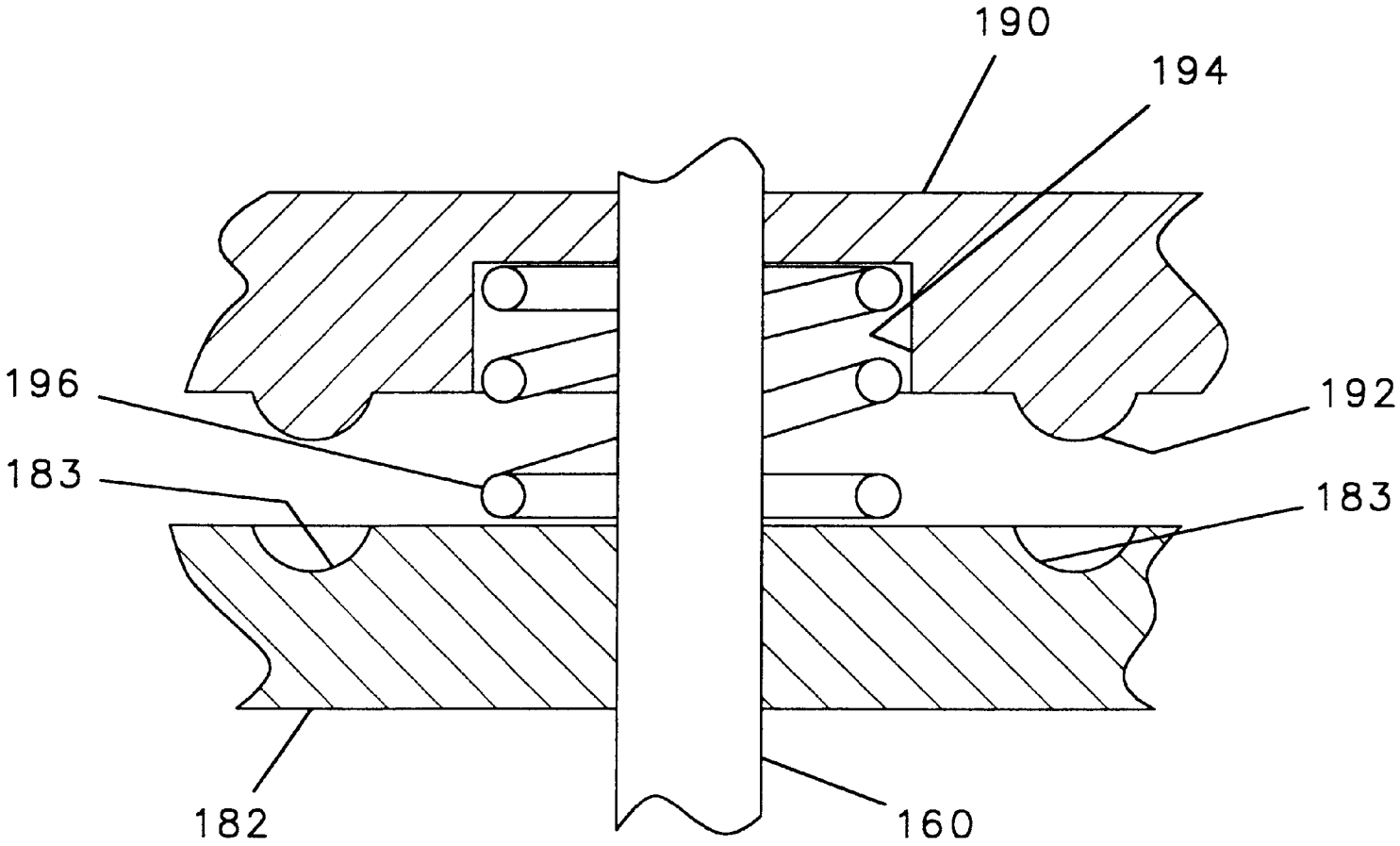
FIG. 12 is an enlarged cross sectional view of the engaging parts of the clutch shown in FIGS. 10 and 11.

Referring to FIGS. 10, and 12, fixed to the shaft 160 is an annular locking member 190 having a planar lower surface with an annular pattern of equally spaced protrusions 192—192 thereon where the number, sizes, and spacings for the protrusions 192—192 are complementary to the number, sizes, and spacings of the indentations 183—183 in the upper surface of the spurgear 182 so as to be engageable therewith. A counter sink 194 around the shaft 160 has a coil spring 196 fitted therein which urges the spurgear 182 into an abutment against the pinion gear 184. The gears 182 and 184 are therefore axially retained along the length of the shaft 178 between the coil spring 196 and the spaces 188 so as to retain gear 182 in engagement with the gears on the motor shaft, not shown, and gear 184 in engagement with the gear on the output shaft 164. Also, the countersink 194 is sufficiently deep to receive the compressed spring 196 and permit downward movement of the shaft 178 from the position shown in FIG. 10 to the position shown in FIG. 11.

At the upper end of the shaft 178 is a collar 198 to which the lever arm 174 is attached and between the collar 198 and the upper surface of the bracket 42' is a load coil spring 200 which urges the shafts 178 and the lever arm 194 upward.

Energizing the solenoid 166 will move the lever arm 174 downward thereby moving the shaft 178 and the locking member 190 from the position shown in FIG. 10 the position shown in FIG. 11 and compressing springs 196 and 200. The pattern of protrusions 192—192 on the locking member 190 will thereby be forced into mating engagement with the pattern of indentations 183—183 on the spurgear 182 and will cause the shaft 178 to rotate with the spurgear 182 such that rotational power will be applied to the output shaft 164. When the solenoid 166 is de-energized, the springs 196, 200 will move the shaft 178 and the locking member 190 upward from the position shown in FIG. 11 to the position shown in FIG. 10. It should be appreciated that the protrusions 192—192 and the indentation 183—183 can be shaped such that the application of torque from the spurgear 182 to the locking member 190 will apply an axial force against the locking member 190 which urges the protrusion 192—192 out of mating relationship with the indentations 183—183. The springs 196, 200 can therefore be selected and adjusted so that a torque applied to the shaft 178 which exceeds the limitation of the motor 162 will cause the locking member 190 to become disengaged from the spur gear 182 to thereby prevent the failure of the motor 162.

While a number of embodiments of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. A door operating device for opening and closing a door in an opening in a wall, said device comprising in combination:

a linkage having first means for connecting to a door and second means for connecting to a wall, reversible electric motor means for driving said linkage for moving said door toward an open condition when said electric motor means is driven in a first direction and for moving said door toward a closed condition when said electric motor means is driven in a second direction, clutch means for connecting and disconnecting said electric motor means to said linkage, means for engaging said clutch means upon the direction of electric power to said reversible motor means and for disengaging said clutch means upon the termination of electric power to said electric motor means, start means for receiving an instruction to initiate the operation of said device, door open sensor means for detecting that said door is in an open condition, door closed sensor means for detecting that said door is in an open condition, and control means connected to said electric motor means and responsive to said door open sensor means, said door closed sensor means, and said start means, for directing electric power to said motor means upon actuation of said start means and for terminating electric power to said motor means upon receipt of a signal from one of said door open sensor means and said door closed sensor means.

2. A door opening devise in accordance with claim 1 wherein said clutch means is electrically operated.

3. A door opening device in accordance in claim 2 wherein said control means simultaneously directs power to said electric motor means and to said clutch means.

4. A door opening device in accordance with claim 2 wherein said clutch means comprises a solenoid.

5. A door opening device in accordance with claim 2 wherein said clutch means is engaged to drivingly connect said motor to said linkage when electric power is applied to said clutch means and is disengaged when electric power to said clutch means is terminated.

6. A door opening device in accordance with claim 2 wherein said clutch means will engage and disengage to convey rotational power from said motor to said linkage when said motor is operated in either a first rotational direction or a second rotational direction opposite said first rotational direction.

7. A door opening device in accordance with claim 1 wherein said clutch means further comprises a rotatable output shaft drivingly connected to said motor, an annular locking member around said shaft, said locking member locked against axial movement along said shaft, said shaft rotatable within said locking member, an engagement member on said shaft, said engagement member longitudinally slideable on said shaft and locked for rotation with said shaft, a protrusion on one of said locking members and said engagement member, and an indentation on the other of said locking members and said engagement member positioned for receiving said protrusion when said engagement member is moved against said locking member.

8. A door opening device in accordance with claim 7 wherein said locking member is non-rotatably attached to an arm for rotating said arm when said protrusion engages said indentation.

9. A door opening device in accordance with claim 7 and further including a gear integral with said locking member.

10. A door opening device in accordance with claim 7 and further including a solenoid having an output shaft, said solenoid output shaft drivingly connected to said engagement member for longitudinally moving said engagement member along said shaft.

11. A door opening device in accordance with claim 1 wherein said clutch means further comprises a shaft mounted for both axial and rotational movements.

12. A door opening device in accordance with claim 11 wherein said clutch means further comprises a first annular member on said shaft, said first annular member locked for axial movement with said shaft, a second annular member on said shaft, and said shaft axially slideable within said second annular member.

13. A door opening device in accordance with claim 12 and further comprising a solenoid for providing axial movement to said shaft.

14. A door opening devise in accordance with claim 11 wherein said clutch means further comprises a first annular member on said shaft, said first annular member locked for rotational movement with said shaft, a second annular member mounted for rotation independent of said shaft, and one of said first and said second annular members mounted for axial movement with said shaft, the other of said first and said second annular members locked against axial movement with said shaft, and locking means on said first annular member and said second annular member for selectively locking and unlocking said second annular member for rotation with said first annular member.

15. A door opening devise in accordance with claim 14 and further comprising a solenoid, said solenoid for providing axial movement to said shaft.

16. A door opening devise in accordance with claim 15 and further comprising a lever arm for conveying axial movement to said shaft.

17. A door opening devise in accordance with claim 14 wherein said locking means comprises at least one protrusion on one of said first and second annular members and at least one complementary indentation on the other of said first and second annular members.

18. A door opening devise in accordance with claim 17 wherein said at least one protrusion and said at least one indentation are shaped to force said first and second members out of engagement with each other in the event a torque applied through said shaft to said motor exceeds the torque limits of said motor.

19. A door opening device in accordance with claim 1 wherein said clutch means further comprises an axially moveable and rotationally moveable shaft, a first annular member on said shaft locked for rotational movement with said shaft, a second annular member on said shaft, said second annular member free to rotate independent of said shaft, and locking means between said first annular member and said second annular member for selectively locking and unlocking said second annular member for rotation with-said first annular member.

20. A door opening device in accordance with claim 19 wherein said locking means comprises at least one protrusion on one of said first and second annular members and at least on complementary-indentation on the other of said first and second annular members.

21. A door opening device in accordance with claim 20 wherein said at least one protrusion and said at least one indentation are shaped to force said first and second members out of engagement with each other in the event a torque applied through said shaft to said motor exceeds the torque limits of said motor.

* * * * *

UNITED STATES PATENT AND TRADEMARK OFFICE

CERTIFICATE OF CORRECTION

PATENT NO. : 6,067,753
DATED : May 30, 2000
INVENTOR(S) : Thomas J. Hebda

It is certified that error appears in the above-indentified patent and that said Letters Patent is hereby corrected as shown below:

In column 3, line 63, after "transverse" delete "hold" and substitute --hole--.

In column 4, line 6, after "counterbore 80" delete "and" and substitute --in--.

In column 10, line 30, after "least" delete "on" and substitute --one--.

In column 4, line 22, after "interfere" delete "wit" and substitute --with--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*